US005996651A

United States Patent [19]

Scaringe

[11] Patent Number: 5,996,651

[45] Date of Patent: Dec. 7, 1999

[54] METHOD AND APPARATUS FOR INTRODUCING LIQUID ADDITIVE INTO VAPOR-COMPRESSION SYSTEMS

[75] Inventor: Robert Peter Scaringe, Rockledge, Fla.

[73] Assignee: Mainstream Engineering Corp., Rockledge, Fla.

[21] Appl. No.: 09/038,109

[22] Filed: Mar. 11, 1998

[51] Int. Cl.[6] ..... B65B 1/04

[52] U.S. Cl. ..... 141/98; 141/9; 141/67; 141/4; 141/99

[58] Field of Search ..... 141/2, 4, 98, 67, 141/38, 9, 99; 184/1.5

[56] References Cited

U.S. PATENT DOCUMENTS

| | | | |
|---|---|---|---|
| 5,070,917 | 12/1991 | Ferris et al. . | |
| 5,386,857 | 2/1995 | Fogal, Sr. et al. | 141/5 |
| 5,746,259 | 5/1998 | Noble, III | 141/98 |

OTHER PUBLICATIONS

UView Brochure on Ultraviolet Leak Detection, 6 pages, No date Available.

EF Products, Inc. (Product Information on Quest), 2 pages, No Date Available.

*Primary Examiner*—Steven O. Douglas

*Attorney, Agent, or Firm*—Evenson McKeown Edwards & Lenahan P.L.L.C.

[57] ABSTRACT

An injector employs a method for introducing an exact amount of liquid additive into operating vapor-compression systems and the like. The injector has a chamber and a piston-cap which have a loose fitting threaded connection to define a leakage path for removing excess liquid additive and undesirable non-condensable gas. After filling the chamber with the liquid additive and screwing the piston-cap back onto the chamber, each end of the injector is connected via Schraeder valves to the high and low sides of an operating vapor-compression system through refrigeration hoses with valve depressors.

8 Claims, 7 Drawing Sheets

METHOD AND APPARATUS FOR INTRODUCING LIQUID ADDITIVE INTO VAPOR-COMPRESSION SYSTEMS

BACKGROUND AND SUMMARY OF THE INVENTION

The present invention relates to a method and apparatus for introducing liquid additive into vapor-compression systems and the like, and more particularly, to a method and apparatus whereby it can be ensured that addition of the liquid does not introduce any air or other non-condensable gases into the system.

It is sometimes necessary to add oil or other liquids into a vapor-compression refrigeration or air conditioning system without in any way interrupting the operation of the system. One conventional way to do this has been to use the natural pressure difference developed by the compressor of an operating system to push the liquid additive into the system. For example, the compressor discharge or high-side pressure service valve on the system can be connected to the one port of a dual valve recovery tank and the other port of the recovery tank connected to the low-side or suction-side of the system. Opening the recovery tank valves drives the tank's contents into the operating system. This tank must first be filled, however, with the substance to be injected into the system.

One way to charge liquid into a system using this dual valve recovery tank is to immerse a hose connected to the liquid connection of an empty recovery tank into the liquid to be added as seen in FIG. 1(*a*). The vapor connection of the recovery tank is then be connected to a vacuum pump. Turning on the vacuum pump creates a vacuum to draw liquid into the tank. When sufficient liquid had been drawn into the tank the liquid connection to the tank is closed, and the vacuum pump is operated to remove the air out of the system as seen in FIG. 1(*b*). Having introduced the liquid into the recovery tank and removed the trapped air, this liquid is then driven into the system using hoses connected to the high-side and low-side of the system as described above and connected as shown in FIG. 1(*c*).

Alternatively the recovery tanks can be opened by, for example, removing a valve or an access plug, and the liquid to be introduced into the system is poured into the tank as seen in FIG. 1(*d*). The tank is then be sealed up again, and the trapped air is drawn out of the system via a vacuum pump. It is, however, necessary to remove any trapped air before using the pressure difference of an operating system to push the liquid into the system. Failure to remove the trapped air results in this air being undesirably driven into the vapor compression system.

U.S. Pat. No. 5,070,917 discloses in FIG. 10 a compact device for introducing a liquid into a vapor compression system utilizing a removable inlet connectable to a source of pressurized refrigerant and a check valve incorporated into at least one of the inlet or outlet, and a transfer member for sealing and retaining the treatment liquid. This device can also utilize a second method of introduction of the liquid by way of a threading action to drive the liquid into the system instead of using the vapor compression system's pressure to drive the liquid into the system.

UView Ultraviolet Systems Inc. sells an injection tool which uses a ratcheted plunger to push liquid to be injected into the system. This approach does not use the pressure difference of the system to drive the liquid into the system but rather uses the pressure developed by the ratchet mechanism on a liquid plunger to push the liquid into the system.

Another, more improved approach developed by Mainstream Engineering Corporation of Rockledge, Fla., the assignee of the present invention, uses an injector comprised of a small chamber as seen in FIG. 2(*a*) to introduce this liquid into the system rather than a large recovery tank. This injector is smaller and easier to carry around compared to the larger recovery bottle and uses a single resealable valve core which is automatically opened by a connection to a standard refrigeration hose with valve core depressor. A valve is necessary to allow the chamber of the device to be filled with liquid without the liquid leaking out of the bottom of the chamber as it is filled. The use of a resealable valve core, which is opened by a valve core depressor, is less expensive than a traditional hand valve.

This device has a practical limitation which has led to the present invention. In particular, I found that, when the device was filled, trapped air in the device still needed to be removed even though the quantity of trapped air was significantly less than in prior arrangements. This small volume of trapped air again required a vacuum pump to evacuate the vapor space as seen in FIG. 2(*b*).

Another problem was that only one self-sealing resealable valve core was provided on the base of the chamber, i.e. inside the flare fitting as shown in FIG. 2(*a*). Thus, the liquid fill would easily leak out of the top (open fitting) while it was being connected if the device was not held upright. A second self-sealing fitting could not be used because if both fittings were leak-tight when the cap was screwed on, the pressure inside the system would build as the cap was tightened because there is essentially no path for the trapped liquid and vapor to exit as the cap was tightened. As a result, the cap does not always properly tighten down because of this pressure build-up.

The present invention overcomes the problems found in conventional devices by providing a chamber with a removable screw piston-cap. More specifically, the threads on the cap are purposely machined with significant thread play (e.g. a very coarse or very fine loose fit thread is used) so as to allow a significant leakage path between the mating male-threaded piston-cap and female threaded chamber body. The piston-cap is configured with an extended threaded or unthreaded internal protrusion or piston which acts to displace air or liquid as the cap is threaded into the female chamber. The purpose of this internal piston is to drive air or excess liquid fill, out of the chamber by leaking past the mating male and female treads so that no non-condensable vapor remains and an exact charge of liquid is always introduced into the chamber in those cases where the chamber is sufficiently filled before closing and the chamber must use a valve at the chamber base to contain the liquid.

The sealing of the cap to the chamber is accomplished in accordance with the present invention by a conventional O-ring face seal between a flat surface on the cap and a corresponding flat surface on the chamber. The threads are not used for sealing as noted above due to their coarseness. The chamber end face is fitted with an O-ring groove to properly trap the O-ring, protect the O-ring from damage associated with the rotational motion of the piston-cap relative to the chamber and assist in sealing.

The O-ring groove is not sized to the exact circumference as is normally done, but instead is sized to accommodate the O-ring in its original circumference as well as in its elongated size. Consequently, an O-ring groove results with an inner radius to accommodate the original O-ring diameter and an outer radius to accommodate the O-ring after the O-ring's diameter has increased due to swelling in the presence of some liquid additives. While proper O-ring materials can minimize elongation and swelling, even the best materials exhibit some swelling over prolonged use. Thus, the widened O-ring groove has been found to provide the best overall solution to the swelling problem.

The piston-cap configuration according to the present invention advantageously allows the excess liquid fill or trapped air to escape until the flat shoulder on the piston-cap finally seals against the O-ring surface of the chamber. This approach assures that air is not trapped in the chamber as long as the chamber is filled to a minimum volume swept by the piston-cap prior to sealing. Another advantage achieved is that the liquid charge can never be exceeded, because excess liquid is squeezed out in the same manner as the trapped air is removed, i.e. by displacement of the piston cap into the chamber.

The present invention also allows the use of a valve on both the chamber body and piston-cap because pressure does not build as the cap is tightened. The device uses a standard flare-fitting on each end to attach to a standard refrigeration hose and allow the refrigerant pressure between the high and low sides of an operating compressor to push the liquid into the operating system.

To further simplify the operation of this device, we have incorporated resealable valve-core depressors, also known in the industry as a Schraeder valves, on both ends of the device as part of the flare fittings in the piston-cap and chamber body. Both ends of the device can be fitted with self-sealing Schraeder valves because the device does not seal until the piston-cap seats on the O-ring in the chamber body.

One advantage of the present invention is that the device is field refillable without the need for any special tools.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

With regard to the conventional approaches shown in FIGS. 1(*a*)–1(*d*), the steps include the following:

1. Introduce the liquid additive into an empty dual-valve recovery tank 10 by removing the valve (or removing an access plug) and pouring the liquid from a container 11 into the tank as seen in FIG. 1(*d*). After adding the correct amount of liquid reseal the tank. Alternatively, a vacuum pump connected to the tank's vapor connection can be used to draw liquid into the tank from the liquid connection as seen in FIG. 1(*a*).
2. Use a vacuum pump connected to the vapor line to remove any trapped air from the tank as seen in FIG. 1(*b*).
3. Connect the vapor valve to the high-side on an operating system and the liquid valve to the low side of an operating system as seen in FIG. 1(*c*). Opening the valves 12, 13 will allow the liquid to be driven into the system by the pressure difference.

Figure 1A:
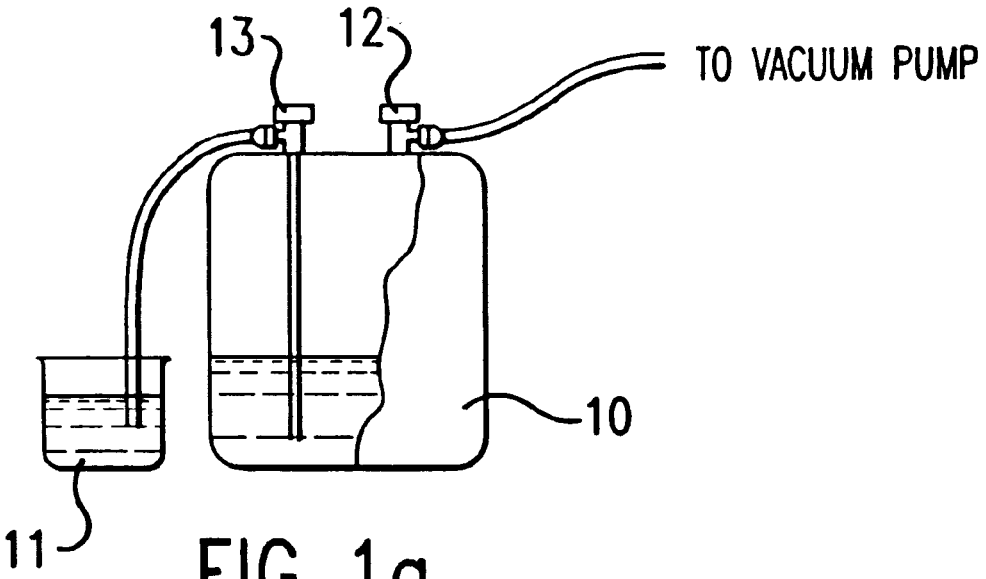
FIG. 1a PRIOR ART
FIGS. 1(*a*)–1(*d*) are schematic diagrams of a conventional method of introducing a liquid additive into an operating system.
Figure 1B:
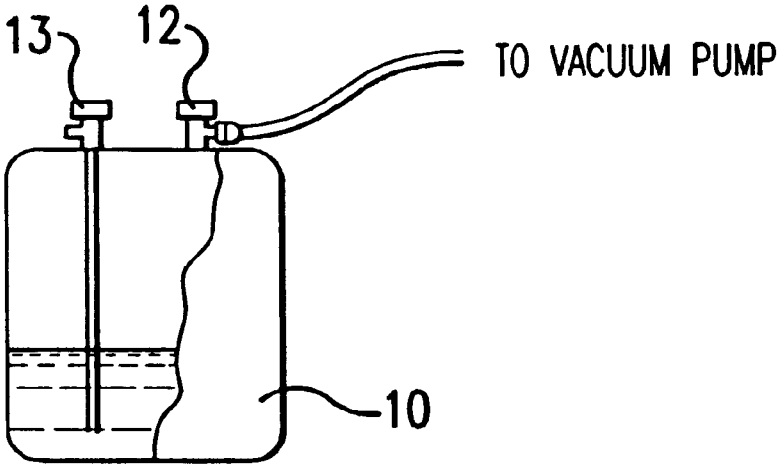
FIG. 1b PRIOR ART
Figure 1C:
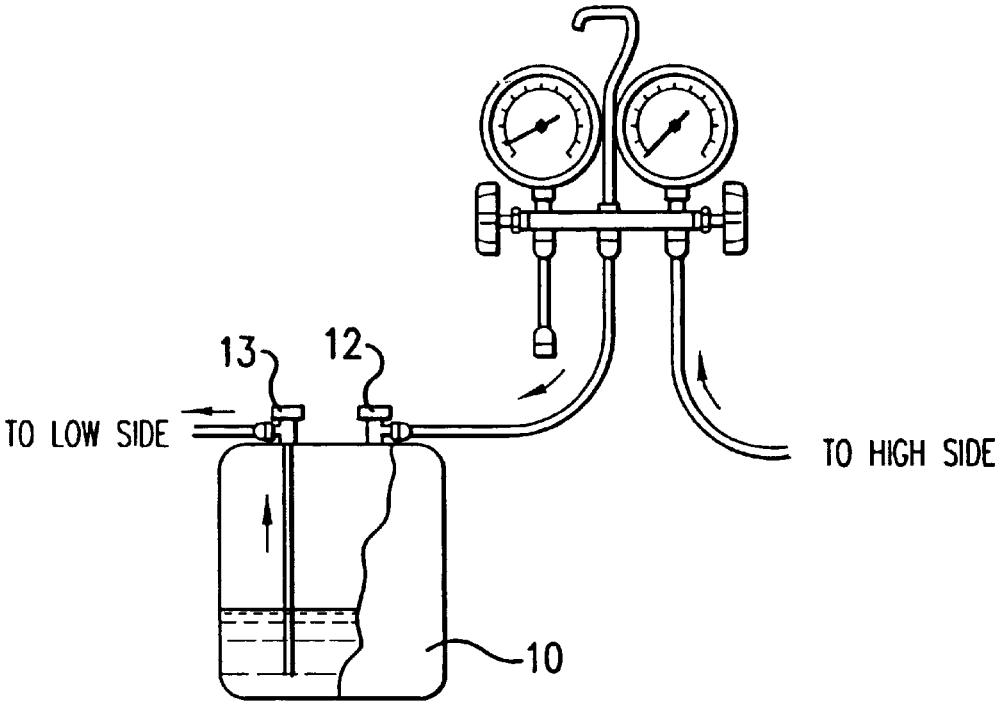
FIG. 1c PRIOR ART
Figure 1D:
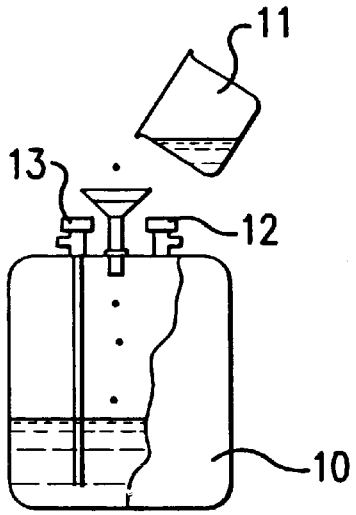
FIG. 1d PRIOR ART
Figure 2A:
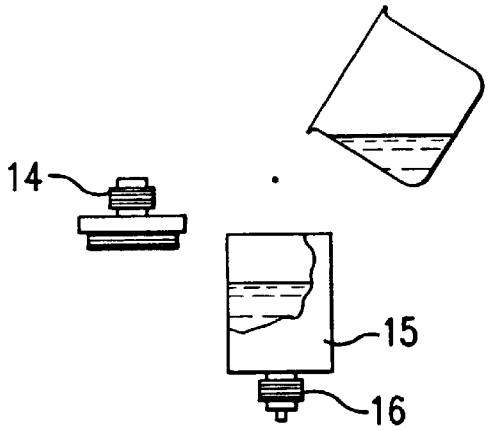
FIG. 2a PRIOR ART
FIGS. 2(*a*)–2(*c*) are schematic diagrams of an improved, now conventional method developed at Mainstream Engineering Corporation for introducing liquid additive into an operating system.
Figure 2B:
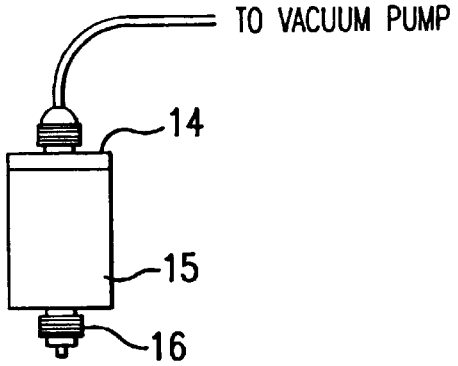
FIG. 2b PRIOR ART
Figure 2C:
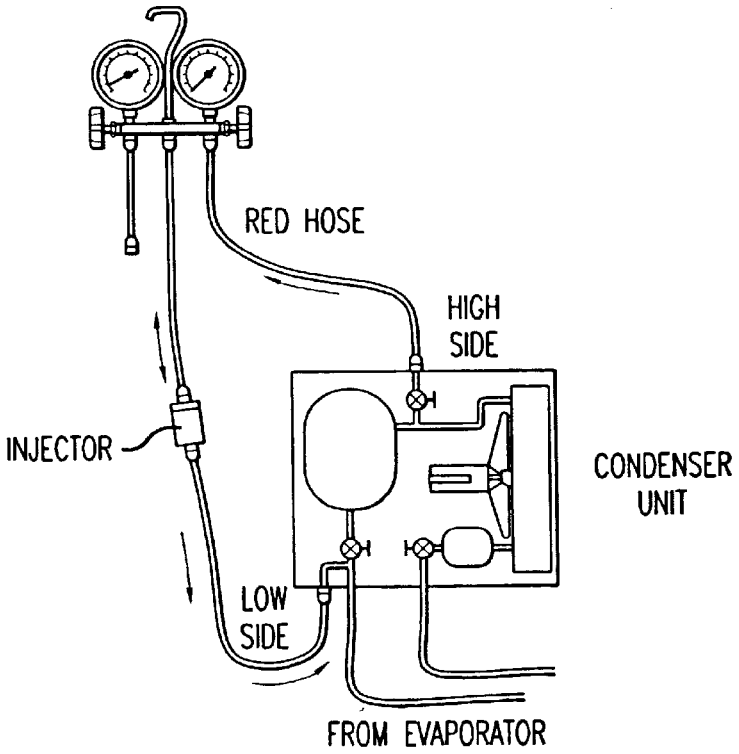
FIG. 2c PRIOR ART

Referring now to FIGS. 2(*a*)–2(*c*), the improved conventional steps include:

1. Unscrew the injector cap 14 and fill the chamber 15. Liquid will not leak out the base of the chamber because the resealable valve 16 is closed until it is connected to a refrigeration hose containing a valve-core depressor within the hose connection.
2. Thread the cap 14 on the chamber body 15. A vacuum can be attached to remove the trapped air while maintaining the injector in the vertical position to avoid the liquid being drawn into the vacuum pump.
3. Connect the injector between the high and low sides of an operating vapor-compression system. One refrigeration hose with a valve core depressor must be used on the hose end which connects to the flare fitting on the chamber body 15 because this connection has a resealable valve 16 in the fitting.

Figure 3:
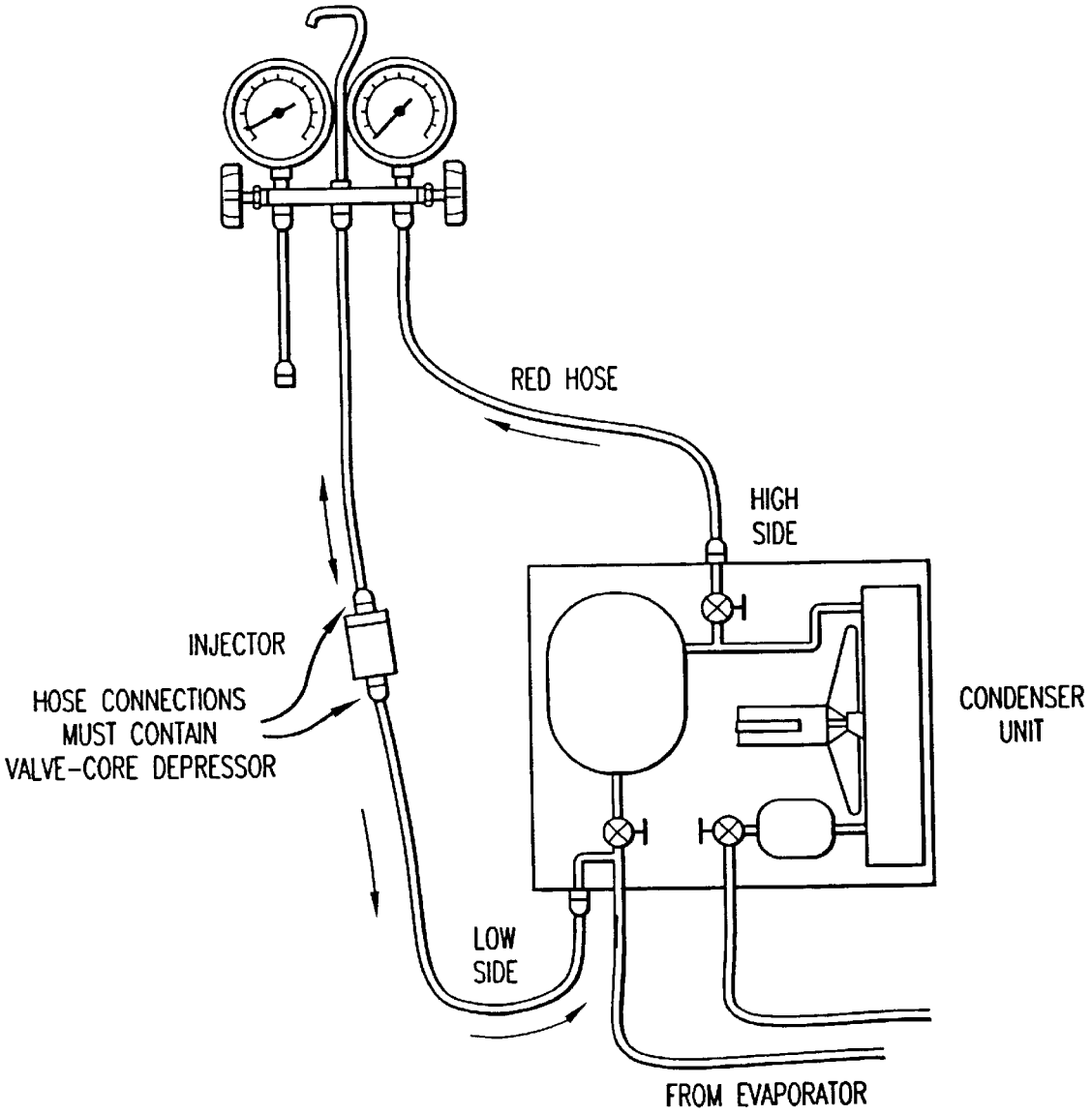
FIG. 3 is a schematic view of a field connection for using the improved device and method of the present invention for introducing liquid additive into an operating vapor-compression system.
Figure 4:
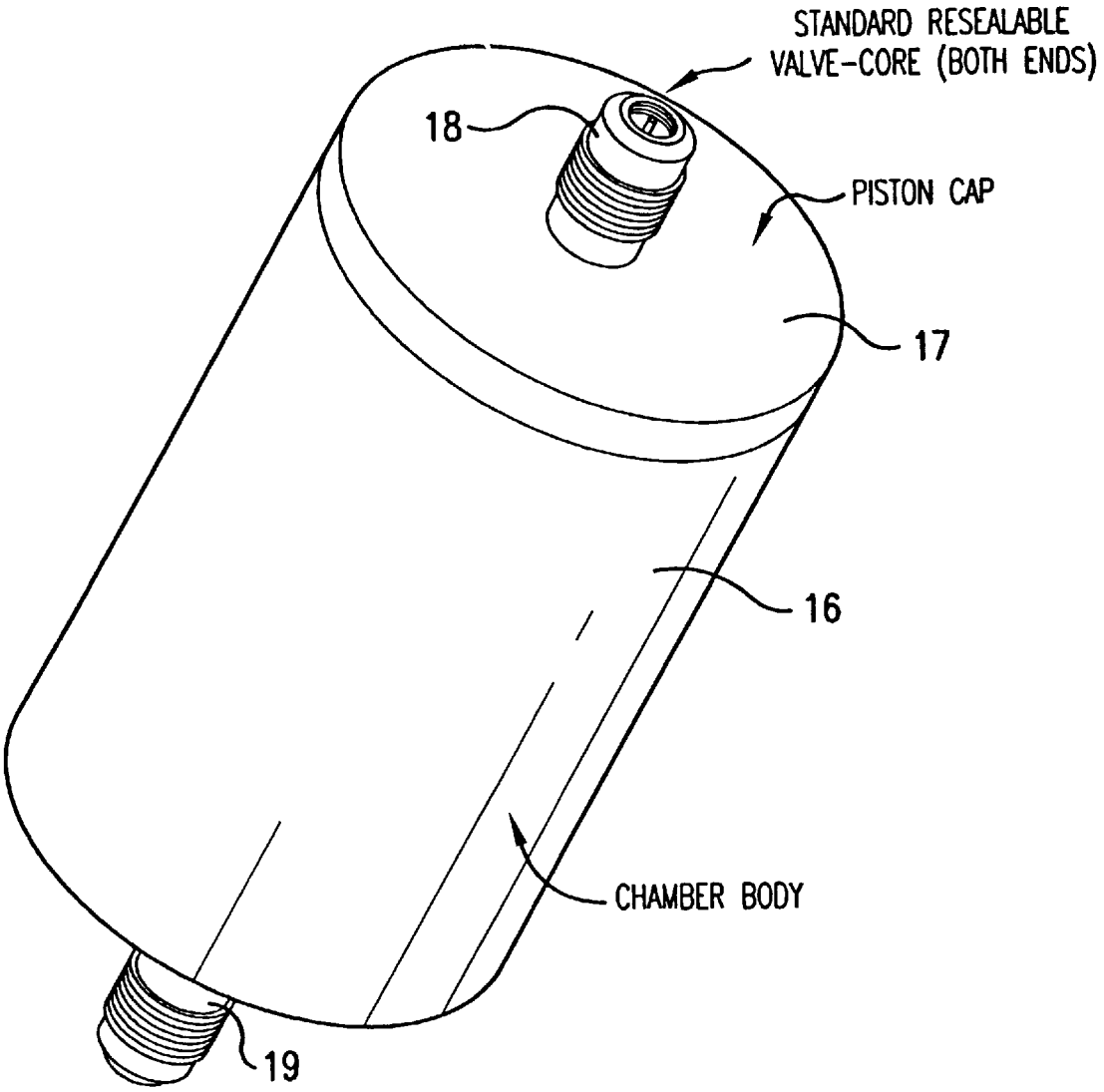
FIG. 4 is an isolated perspective view of the device shown in FIG. 3.
Figure 5A:
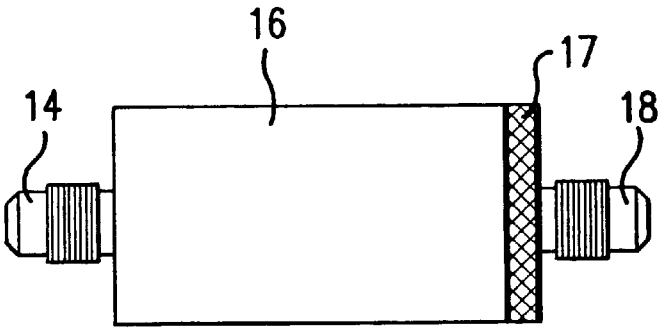
FIGS. 5(*a*)–5(*d*) are elevational, partially cut-away, piston-cap elevational and chamber body end views, respectively, of the device shown in FIGS. 3 and 4.
Figure 5B:
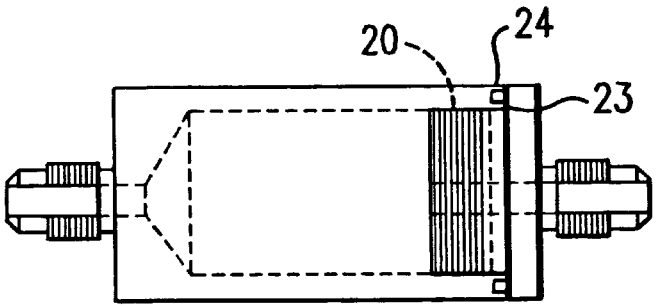
Figure 5C:
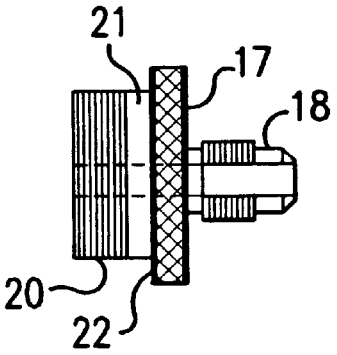
Figure 5D:
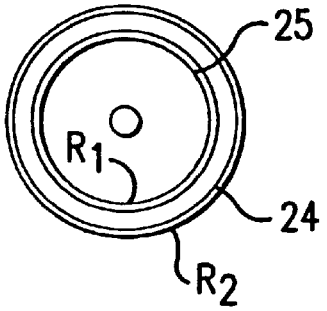

A self-explanatory schematic view of the arrangement used to drive the liquid additive into an operating system using the present invention by the differential pressure between the high and low sides of an operating system is shown in FIG. 3. FIGS. 4 and 5(*a*)–5(*d*) show details of the device of the present invention.

Figure 6A:
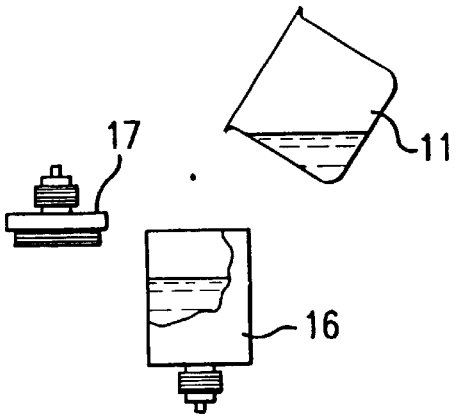
FIGS. 6(*a*)–6(*c*) are schematic diagrams for using the device in FIGS. 4 and 5(*a*)–5(*d*) for introducing the liquid additive into the vapor-compression system for obtaining the field connection of FIG. 3.
Figure 6B:
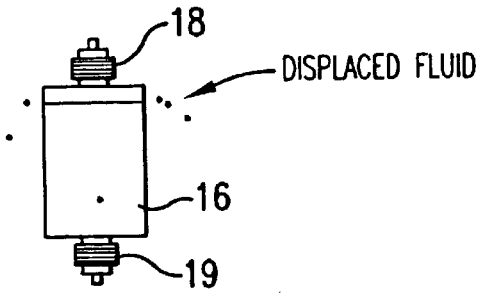
Figure 6C:
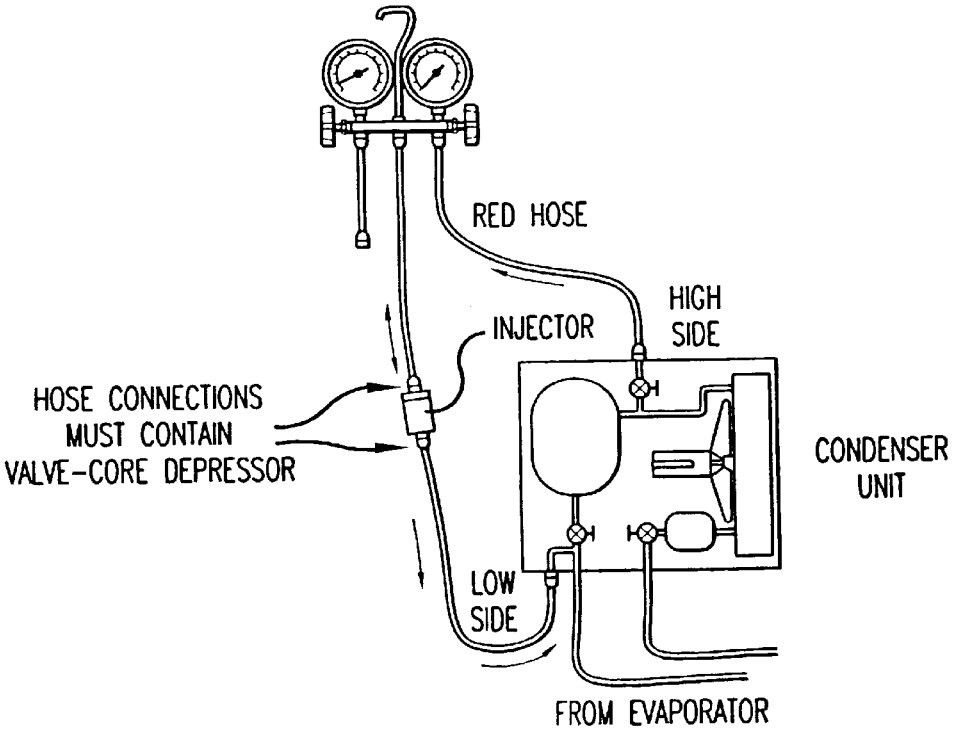

That is, the device includes a chamber body 16, a removable screw piston cap 17 and standard resealable valve cores 18, 19 at each end of the chamber body 16. As noted above, the threads 20 on the cap 17 are purposely machined with significant thread play so as to allow a significant leakage path between the mating male-threaded piston-cap 17 and female threaded chamber body 16. The piston-cap 17 is so named because it has an extended threaded or unthreaded internal protrusion or piston 21 which acts to displace air or liquid as the cap 17 is threaded into the female chamber 16. The purpose of this internal piston 21 is to drive air or excess liquid fill out of the chamber 16 by leaking the air or excess liquid through the leakage path of the mating male and female threads as seen in FIG. 6(*b*). Thereby, no non-condensable vapors remain and an exact charge of liquid is always introduced into the chamber 16 as long as the chamber is sufficiently filled before closing as seen in FIG. 6(*a*). The chamber 16 must use a valve 19 at the chamber base to contain the liquid.

The sealing of the cap 17 to the chamber 16 is accomplished by a conventional O-ring face seal between a flat surface 22 on the cap 17 and a corresponding flat surface on the top surface 23 of the chamber 16. The threads 20 are not used for sealing as above noted. The chamber end face 23 is fitted with an O-ring groove 24 to properly trap the O-ring 25 to protect the O-ring 25 from damage associated with rotational motion of the piston-cap 17 relative to the chamber 16, and to aid in sealing. The O-ring groove 24 is not sized to the exact circumference of the O-ring 25 as is normally done, but instead is sized to accommodate the O-ring 25 in its original circumference as well as in its elongated size. Thereby, an O-ring groove 24 results with an inner radius $R_1$ (FIG. 5(*d*)) to accommodate the original O-ring diameter and an outer radius $R_2$ to accommodate the O-ring 25 after the O-ring's diameter has increased. The O-ring diameter increases due to swelling in the presence of some liquid additives. While proper O-ring materials can minimize elongation and swelling, even the best materials exhibit some swelling over prolonged use, and I have found that this widened O-ring groove 24 has provided the best solution to the swelling problem.

The piston-cap 17 configuration allows the excess liquid fill or trapped air from the steps shown in FIG. 6(*a*) to escape until the flat shoulder on the piston-cap finally seals against the O-ring surface of the chamber as seen in FIG. 6 (*b*). This method will assure that air is not trapped in the chamber as long as the chamber is filled to a minimum volume swept by the piston-cap prior to sealing. This approach also assures that the liquid charge can never be exceeded because excess liquid would be squeezed out in the same manner as the trapped air is removed, namely by the displacement of the piston cap into the chamber. This approach also allows the use of a valve on both the chamber body and piston-cap because pressure does not build as the cap is tightened. The device uses a standard flare or alternatively quick-disconnect fitting 18, 19 on each end to attach to a standard refrigeration hose and allow the refrigerant pressure between the high and low sides of an operating compressor to push the liquid into the operating system as seen in FIG. 6(*c*). To further simplify the operation of this device, I have incorporated resealable valve-core depressors, also known in the industry as a Schraeder valves, on both ends of the device as part of the flare fittings 18, 19.

In the filling and introducing method of the present invention shown in FIGS. 6(*a*)–6(*c*) the following steps are involved for introducing an exact charge of liquid into an operating air conditioning or refrigeration system:

1. Unscrew the injector's piston-cap 37 and fill the chamber 16. Liquid -will not leak out the base of the chamber because the resealable valve 19 is closed until it is connected to a refrigeration hose containing a valve-core depressor within the hose connection.
2. Thread the piston-cap 17 onto the chamber body 16. As the piston-cap 17 is threaded down to its final resting position, liquid is squeezed out of the threaded space between the cap 17 and chamber 16 as excess liquid and trapped air is displaced.
3. Connect the injector between the high and low sides of an operating vapor-compression system. Refrigeration hoses with valve core depressors must be used on hose ends which connect to the injector.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for injecting an exact volume of liquid additive into a operating vapor-compression system without introducing any air or other non-condensable gases into the system, comprising a chamber for holding a predetermined amount of the liquid additives and an apparatus operatively associated with the chamber with an associated means for displacing undesired gas and liquid in a path between the apparatus and the chamber.

2. The device according to claim 1, wherein the apparatus is a piston-cap.

3. A device for injecting an exact volume of liquid additive into an operating vapor-compression system without introducing any air or other non-condensable gases into the system, comprising a chamber for holding a predetermined amount of the liquid additive, and a piston cap apparatus operatively associated with the chamber to displace undesired gas and liquid, wherein a loose fitting threaded connection is provided between the piston-cap and the chamber.

4. The device according to claim 3, wherein an O-ring face seal is arranged to provide sealing between the chamber and the piston-cap.

5. The device according to claim 4, wherein resealable valves are provided on the chamber and piston-cap whereby a leakage path exists only through the loose fitting threaded connection.

6. The device according to claim 5, wherein the resealable valves comprise valve cores automatically openable by connection with standard refrigeration hoses having conventional valve core depressors.

7. A device for infecting an exact volume of liquid additive into an operating vapor-compression system without introducing any air or other non-condensable gases into the system, comprising a chamber for holding a predetermined amount of the liquid additive, and an apparatus operatively associated with the chamber to displace undesired gas and liquid, wherein an O-ring seal is provided in an oversized groove between opposed faces of the chamber and the apparatus.

8. A method for injecting an exact volume of liquid additive into an operating vapor-compression system without introducing any other non-condensable gas into the system, comprising the steps of:

(a) unscrewing a cap from an injector chamber to expose a threaded piston on the cap.

(b) entirely filling the interior of the chamber with the liquid additive, (c) screwing the cap onto the chamber to displace excess liquid additive out of the chamber through a path defined between the threaded piston and chamber to leave the exact volume of the liquid additive in the chamber, and (d) connecting valves on the cap and the chamber with refrigeration hose on low and high sides of the operating vapor-compression system.

* * * * *